US007346288B2

(12) United States Patent
Sone et al.

(10) Patent No.: US 7,346,288 B2
(45) Date of Patent: Mar. 18, 2008

(54) APPARATUS FOR FIXING TONER ON TRANSFERRED MATERIAL

(75) Inventors: Toshihiro Sone, Yokohama (JP); Osamu Takagi, Chofu (JP); Satoshi Kinouchi, Tokyo (JP); Yoshinori Tsueda, Fuji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 53 days.

(21) Appl. No.: 10/944,855

(22) Filed: Sep. 21, 2004

(65) Prior Publication Data

US 2006/0062586 A1 Mar. 23, 2006

(51) Int. Cl.
*G03G 15/20* (2006.01)

(52) U.S. Cl. ..... 399/69

(58) Field of Classification Search ..... 399/69, 399/67, 68

See application file for complete search history.

(56) References Cited

U.S. PATENT DOCUMENTS

| | | | | |
|---|---|---|---|---|
| 6,724,999 | B2 | 4/2004 | Kikuchi et al. | |
| 2002/0186982 | A1* | 12/2002 | Tamaoki | 399/69 |
| 2004/0175211 | A1 | 9/2004 | Sone et al. | |
| 2004/0175212 | A1 | 9/2004 | Tsueda et al. | |
| 2004/0184852 | A1 | 9/2004 | Takagi et al. | |
| 2004/0265021 | A1 | 12/2004 | Kinouchi et al. | |
| 2005/0117923 | A1* | 6/2005 | Sasamoto et al. | 399/69 X |

FOREIGN PATENT DOCUMENTS

| | | | |
|---|---|---|---|
| JP | 11272119 | A * | 10/1999 |
| JP | 2002-311747 | | 10/2002 |
| JP | 2003-57987 | A | 2/2003 |
| JP | 2003-57989 | A | 2/2003 |
| JP | 2003-229242 | A | 8/2003 |

OTHER PUBLICATIONS

U.S. Appl. No. 10/944,707, filed Sep. 21, 2004, Sone et al.
U.S. Appl. No. 10/805,420, filed Mar. 22, 2004, Sone et al.
U.S. Appl. No. 10/805,308, filed Mar. 22, 2004, Tsueda et al.
U.S. Appl. No. 10/820,138, filed Apr. 8, 2004, Sone et al.
U.S. Appl. No. 10/805,305, filed Mar. 22, 2004, Sone et al.
U.S. Appl. No. 10/945,395, filed Sep. 21, 2004, Kinouchi et al.

* cited by examiner

*Primary Examiner*—David M. Gray
*Assistant Examiner*—Erika J. Villaluna
(74) *Attorney, Agent, or Firm*—Foley & Lardner LLP

(57) ABSTRACT

The present invention relates to a fixing apparatus which radiates rays to a detection object and which detects the rays returned from the detection object to obtain a temperature signal. The apparatus specifies a radiant ratio of the surface of the detection object using at least one of accumulated image forming times, detection position, and radiation deterioration, corrects the detected temperature signal based on the specified radiant ratio of the surface of the detection object to produce temperature data, and controls a power to be supplied to a heating mechanism which raises temperature of the detection object based on the produced temperature data.

7 Claims, 6 Drawing Sheets

APPARATUS FOR FIXING TONER ON TRANSFERRED MATERIAL

BACKGROUND OF THE INVENTION

1. Field of the Invention

The present invention relates particularly to a fixing apparatus which is usable in image forming apparatuses such as a copying apparatus and a printer apparatus in an electrophotographic system using a thermally melting developer and which fixes a developer to an output object.

2. Description of the Related Art

A fixing apparatus incorporated in an image forming apparatus using an electrophotographic process applies heat to a toner (developer) positioned on an output object, that is, a recording material to soften the toner, and applies pressure to the toner to fix the toner to the recording material. In recent years, induction heating has been broadly utilized as a heating system capable of reducing a time from when power supply is started until temperature reaches a fixable temperature at which the toner softens, that is, a heating time.

However, in the fixing apparatus using the induction heating, it is difficult to correctly detect the temperature of a heat roller (heating member) for fixing the toner to the recording material.

There have been many proposals in order to improve these respects.

For example, it has been described in Japanese Patent Application Laid-Open No. 2003-229242 that an apparatus (fixing apparatus) for heating a heating object member by the induction heating has an optical system and a mirror for guiding infrared rays radiated from a heating object member to infrared-ray detection means, and power supplied to heating means for heating the heating object member is controlled based on the detected infrared rays.

For example, it has been described in Japanese Patent Application Laid-Open No. 2003-57987 that in a fixing apparatus comprising a temperature detection device which detects the infrared rays emitted from a fixing roller to thereby speculate and detect the temperature of the fixing roller, infrared-ray emission of the fixing roller in a wavelength region detectable by the temperature detection device is set to be not more than the infrared-ray emission of the toner in the wavelength region, and an infrared-ray detection member has a film member which absorbs the infrared rays.

For example, it has been proposed in Japanese Patent Application Laid-Open No. 2003-57989 that in an apparatus for controlling a surface temperature of a heating/fixing rotary member for a fixing apparatus, comprising: a temperature detection device; and contact state switching means capable of switching a contact state between the temperature detection device and the heating/fixing rotary member, the contact state and non-contact state of surface temperature detection means be switched.

However, the proposal of any of the above-described documents relates to contact temperature detection means. Response of the contact temperature detection means differs from that of a non-contact temperature sensor. Therefore, detected temperature includes a time lag. Therefore, it is difficult to correctly manage fixing temperature of the heat roller. A sliding surface of a detection surface of the contact temperature detection means is deteriorated with life of the heat roller (increase of the number of image formed/fixed sheets). Therefore, the response of the sensor accompanying deterioration of radiation of the infrared rays is deteriorated, and a detected temperature becomes incorrect (wrong detection). As to the infrared-ray radiation, the deterioration differs depending on individual places on the surface of the roller. Therefore, when correction coefficient is equal, the detected temperature includes an error.

BRIEF SUMMARY OF THE INVENTION

An object of the present invention is to provide a fixing apparatus capable of correctly detecting temperature of a heating object over a long term, and stably fixing a toner to a recording material in a constant condition range.

According to the present invention, there is provided a heating apparatus comprising:

a heating member to which energy is supplied to generate heat and to thereby heat a recording material and a developer;

a plurality of heating mechanisms which supply the energy to the heating member and which are disposed in association with a longitudinal direction of the heating member and which selectively allow the heating member to generate the heat in accordance with temperature distribution of the heating member in the longitudinal direction;

a surface state maintaining mechanism which maintains infrared-ray quantity on the surface of the heating member in a predetermined range; and a plurality of temperature detection mechanisms including a plurality of radiated heat detection sections which detect the radiated heat reflected from the heating member without contacting the heating member and a plurality of temperature detection sections which detect ambient temperature of the radiated heat detection section, the plurality of temperature detection mechanisms being disposed using a region in which the heating member generates the heat as a unit.

Moreover, according to the present invention, there is provided a fixing apparatus comprising:

a heating member to which a magnetic field is supplied to generate heat and to thereby heat a recording material and a developer;

a plurality of first and second coil members which supply the magnetic field to the heating member to generate induction heat and which are disposed in a longitudinal direction of the heating member and which are capable of independently supplying the magnetic field;

a surface state maintaining mechanism which maintains infrared-ray quantity on the surface of the heating member in a predetermined range;

a plurality of temperature detection mechanisms including a plurality of radiated heat detection sections which detect the radiated heat reflected from the heating member without contacting the heating member and a plurality of temperature detection sections which detect ambient temperature of the radiated heat detection section, the plurality of temperature detection mechanisms being disposed using a region in which the heating member generates the heat as a unit; and a pressure supplying member which is brought into contact with the heating member in a predetermined position and which fixes the developer to the recording material passed between the pressure supplying member and the heating member.

Furthermore, according to the present invention, there is provided a temperature control method comprising:

radiating rays to a detection object, and detecting the rays returned from the detection object to obtain a temperature signal;

specifying a radiant ratio of the surface of the detection object using at least one of accumulated image forming times, detection position, and radiation deterioration;

correcting the detected temperature signal based on the specified radiant ratio of the surface of the detection object to produce temperature data; and controlling a power to be supplied to a heating mechanism which raises temperature of the detection object based on the produced temperature data.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described hereinafter with reference to the drawings.

Figure 1:
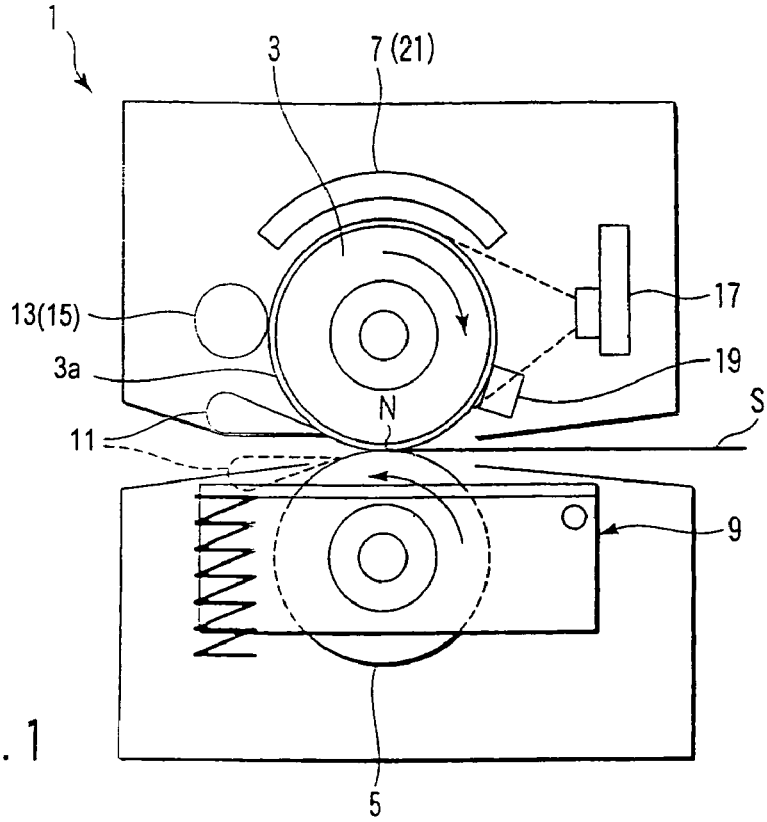
FIG. 1 is a schematic drawing showing one example of a fixing apparatus to which an embodiment of the present invention is applied.

FIG. 1 shows a fixing apparatus to be incorporated in image forming apparatuses such as a copying apparatus and a printer apparatus for fixing a thermally melting developer to a sheet-like output medium to obtain a hard copy, that is, a printing output.

The fixing apparatus has been broadly utilized for fixing a toner (developer) to the sheet-like output medium to obtain the printing output. Examples of the sheet-like output medium include paper, resin sheet and the like. The developer (toner) is electrostatically held by the sheet-like output medium. The fixing apparatus applies heat to the toner and the sheet-like output medium to soften the toner, and applies a predetermined pressure in such a manner as to fix the toner to the medium.

A fixing apparatus 1 has a heat roller 3, a press roller 5, and a heating device 7 of an induction heating system. Axial lines of the heat roller 3 and the press roller 5 are parallel to each other.

The pressure is supplied to the press roller 5 by a pressurizing mechanism (spring and roller holding structure) 9, and accordingly the press roller is pressed onto the heat roller 3. Various known structures are usable in the spring and roller holding structure as long as the press roller 5 can be pressed onto the heat roller 3 with a predetermined pressure.

An outer peripheral portion of the press roller 5 deforms based on the pressure supplied from the pressurizing mechanism 9. A deformed region is referred to as the nip N. The nip N has a predetermined width which is a length of an outer peripheral surface of the rollers 3 and 5. An outer diameter and material of the press roller 5, pressure during the pressing onto the heat roller 3, outer diameter and hardness of the heat roller 3 and the like are appropriately set in such a manner that the width of the nip N falls in a constant range.

A claw 11 is disposed in a predetermined position defined on a downstream side from the nip N along an outer periphery of the heat roller 3 during rotation of the heat roller. The claw 11 is used for releasing (peeling) a sheet (sheet-like medium) S from adhesion between the sheet S and the surface of the heat roller 3 caused by curving (of the sheet S) on the side of the surface of the heat roller. The adhesion is caused by curl of the sheet S itself by fusion bonding of the surface of the heat roller 3 to the toner on the sheet S, or application of the heat.

A plurality of claws 11 may be disposed while associated with intensity of the fusion bonding of the sheet S to the surface of the heat roller 3 or degree of curvature of the sheet S on the side of the roller surface, that is, peelability. The claw 11 may be omitted in a case where the peelability (of the sheet S) is high. The claw 11 may be disposed on the outer periphery of the press roller 5 in a positional relation similar to that with respect to the heat roller 3.

A cleaning roller 13 and/or an oil (coat) roller 15 is disposed in a predetermined position around either or both of the heat roller 3 and the press roller 5. The cleaning roller 13 is used in removing a toner, dust (especially particulates generated from the sheet S) and the like sometimes sticking to the surfaces of the heat roller 3 and the press roller 5. The oil (coat) roller 15 prevents the toner from being fixed to the surfaces of the heat roller 3 and the press roller 5 and/or supplies oil to the surface of the corresponding roller for a purpose of enhancing the peelability of the sheet S described above. The oil is, for example, preferably silicone based.

Non-contact temperature detection means (temperature detection mechanism) 17 and safety device 19 are disposed in predetermined positions in the vicinity of either or both of the heat roller 3 and the press roller 5. The temperature detection mechanism 17 and the safety device 19 are disposed in the positions which are not influenced by a magnetic flux (line of magnetic force) generated from the heating device 7. The temperature detection mechanism 17 detects the temperature of the surface of the heat roller 3. The temperature detection mechanism 17 is a temperature sensor (non-contact), for example, of a thermopile type. The temperature detection mechanism 17 may include, for example, a thermistor of a contact type. At least two temperature detection mechanisms 17 are disposed at a predetermined interval in a longitudinal direction of the heat roller 3.

The temperature detection mechanism 17 is disposed, for example, on an arbitrary surface including an axis of the heat roller 3 when viewed in a peripheral direction (direction of a plane crossing the axis at right angles) of the heat roller 3. The temperature detection mechanism 17 may be disposed in an arbitrary position, for example, in the vicinity of the nip N (upstream of a rotation direction of the heat roller 3) or the heating device 7 (space between the heating device 7 and the heat roller 3), when viewed from the peripheral direction (direction of the plane crossing the axis at right angles) of the heat roller 3. The temperature detection mechanism 17 is capable of detecting, for example, the temperature of the space between the heat roller 3 and the heating device 7 and the temperature around the heat roller 3 in the vicinity of the nip N, that is, temperatures in a plurality of positions in the peripheral direction of the heat roller 3, when viewed in the peripheral direction (direction of the plane crossing the axis at right angles) of the heat roller 3. The safety device 19 is, for example, a thermostat. The thermostat 19 stops an operation of the heating device 7, that is, an output of an induced current in a case where the temperature of the surface of the heat roller 3 rises at a temperature which has not been expected. The rise of the temperature of the surface of the heat roller 3 at the unexpected temperature is caused, for example, by abnormality (burnout/damage) of the temperature detection mechanism 17.

The heat roller 3 has a metal conductive layer 3*a* which generates heat by eddy current generated by the magnetic field (line of magnetic force) supplied by the heating device 7, and is formed, for example, into a tube or rod shape. The heat roller 3 is rotated in an arrow direction centering on an inherent axial line (not shown) by a rotating force supplied by a motor (not shown) or a power transmission mechanism. The outer peripheral surface of the heat roller 3 is moved at a predetermined speed [mm/second] (the heat roller 3 is rotated at a predetermined rotation number, and the speed at which the outer peripheral surface is moved can therefore be obtained from the rotation number). An elastic layer and/or a mold release layer capable of reducing a remaining toner.

The press roller 5 is brought into contact with the outer periphery of the heat roller 3 via the nip N. Therefore, when the heat roller is rotated, the press roller is rotated in an arrow direction at the predetermined rotation number. The outer peripheral surface of the press roller 5 is moved at a predetermined movement speed [mm/second].

The heating device 7 has a coil 21 which supplies a magnetic field having a predetermined intensity to the metal conductive layer 31 of the heat roller 3. The coil 21 is wound around a core (not shown) formed of a magnetic material by the predetermined number of windings, and is formed into a predetermined shape. The coil 21 (heating device 7) may be disposed inside the heat roller 3, when the heat roller 3 is tubular (hollow).

Figure 2:
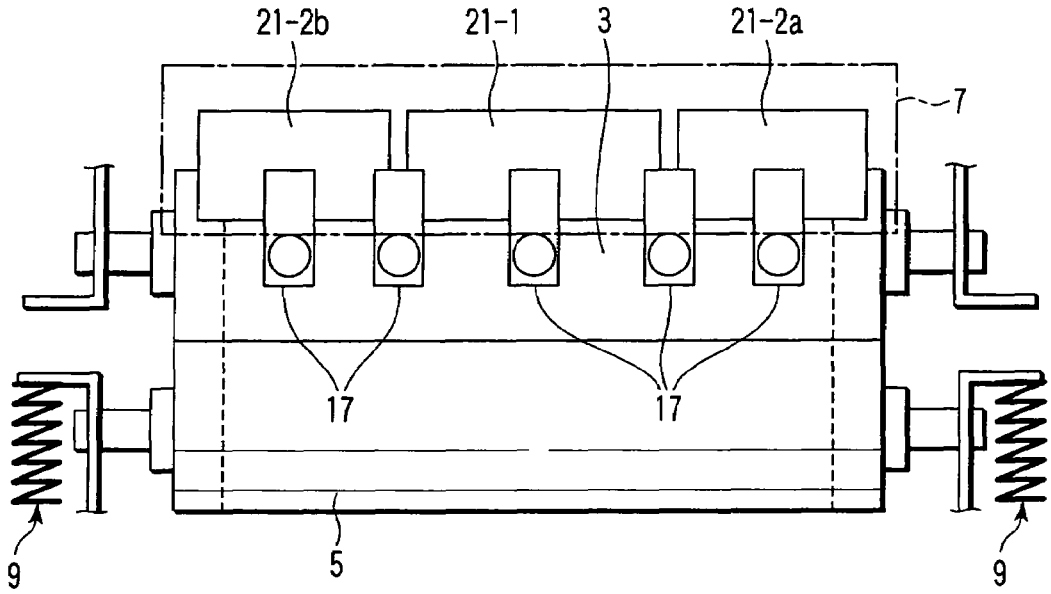
FIG. 2 is a schematic diagram showing an example of a heating apparatus incorporated in the fixing apparatus shown in FIG. 1.

As shown in FIG. 2, the coil 21 is divided, for example, into three along the longitudinal direction of the heat roller 3. Cores are disposed for coils, although not described in detail. When the coil 21 is divided into three, the coil positioned in a middle of heat roller 3 in the longitudinal direction is formed to be electrically equivalent to two coils position in opposite ends. When the coil 21 is divided into three, the coil positioned in the middle of the heat roller 3 in the longitudinal direction is referred to as a first coil 21-1. The coils positioned on opposite sides (end portions of the roller 3 in the longitudinal direction) of the first coil 21-1 with respect to the longitudinal direction of the heat roller 3 are referred to as second coils 21-2. When one of the second coils is identified, they are referred to as a first end coil 21-2*a*, second end coil 21-2*b*. The first end coil 21-2*a* of the second coil is electrically connected to the second end coil 21-2*b* in series. The coils other than the first coil 21-1 are operated under the same control.

A size of the first coil 21-1 is defined in such a manner that a length of the sheet in contact with the heat roller 3 can be heated in a case where the sheet S is a sheet having an at least A4 size and a short side of the sheet S is conveyed in a direction crossing a conveying direction of the sheet S at right angles during the conveying. When a region (width) of the sheet S contacting the heat roller is small as compared with the length of the heat roller 3, power can be supplied only to the middle (first) coil 21-1 in such a manner that the only region corresponding to the contact width of the sheet S can be heated. Since the coil 21 is divided into the middle (first) coil 21-1 and the opposite end (second) coils 21-2, a temperature distribution of the heat roller 3 in the longitudinal direction can be uniformed.

In the image forming apparatus using the fixing apparatus, when the toner is passed through the nip N, that is, a fixing point together with the sheet S, the toner is heated by the heat supplied from the heat roller 3 to soften (the toner is electrostatically positioned on the sheet S as an image to be fixed onto the sheet S). The softened toner receives a predetermined pressure from the heat roller 3 and the press roller 5 in the nip N. By the above-described steps, the toner, that is, an image to be output is fixed onto the sheet S.

Next, a "position" in which the temperature detection mechanism 17 is to be disposed will be described.

Figure 3:
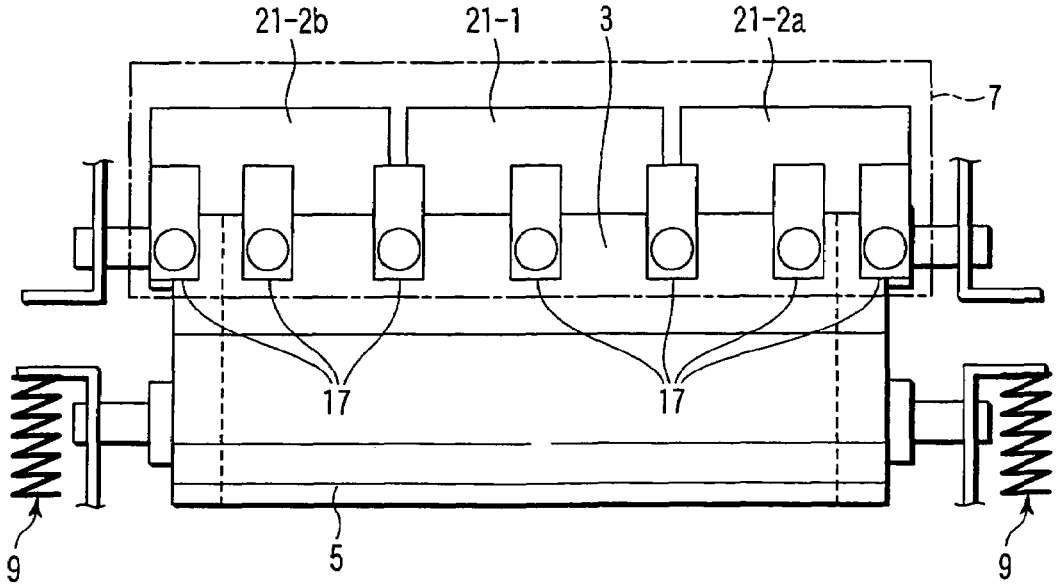
FIG. 3 is a schematic diagram showing another example of the heating apparatus shown in FIG. 2.

The temperature detection mechanism (temperature sensor of the thermopile type) 17 is disposed in association with three divided individual coil spaces with respect to the longitudinal direction of the heat roller 3 shown, for example, in FIG. 2. As to the thermopile type temperature sensor 17, at least two sensors are disposed between the first coil 21-1 and the first end coil 21-2*a* and between the first coil 21-1 and the second end coil 21-2*b* in a projected state along the axis of the heat roller 3. As to the thermopile type temperature sensor 17, preferably three sensors are disposed in a region most heated by the first (middle) coil 21-1, and regions most heated by the second coils 21-2*a* and 21-2*b* with respect to the longitudinal direction of the heat roller 3. Adding the above-described two sensors, five sensors are disposed in total. More thermopile type temperature sensors 17 may be prepared with respect to the longitudinal direction of the heat roller 3. For example, as shown in FIG. 3, when the second coils 21-2 are formed to be long in such a manner as to cover the opposite ends of the heat roller 3, another coil is disposed in each of the opposite ends of the second coils 21-2. Adding the above-described five sensors, seven sensors are disposed.

The thermopile type temperature sensors 17 are positioned in the divided regions on the side of the heat roller 3, when the sheet S is passed through the nip N in a display by a plane (the same direction as that of FIG. 1) crossing the axis of the heat roller 3, that is, in a state in which the sensors are viewed in the same direction as that of FIG. 1. Since the thermopile type temperature sensors 17 are arranged in the above-described positions, the temperature of the space between any of the first coil 21-1, first end coil 21-2*a*, and second end coil 21-2*b* and the surface of the heat roller 3 is detectable. Furthermore, since the thermopile type temperature sensors 17 are arranged in the above-described positions, the temperature of the surface of the heat roller 3 in the vicinity of the nip N is detectable.

Figure 4:
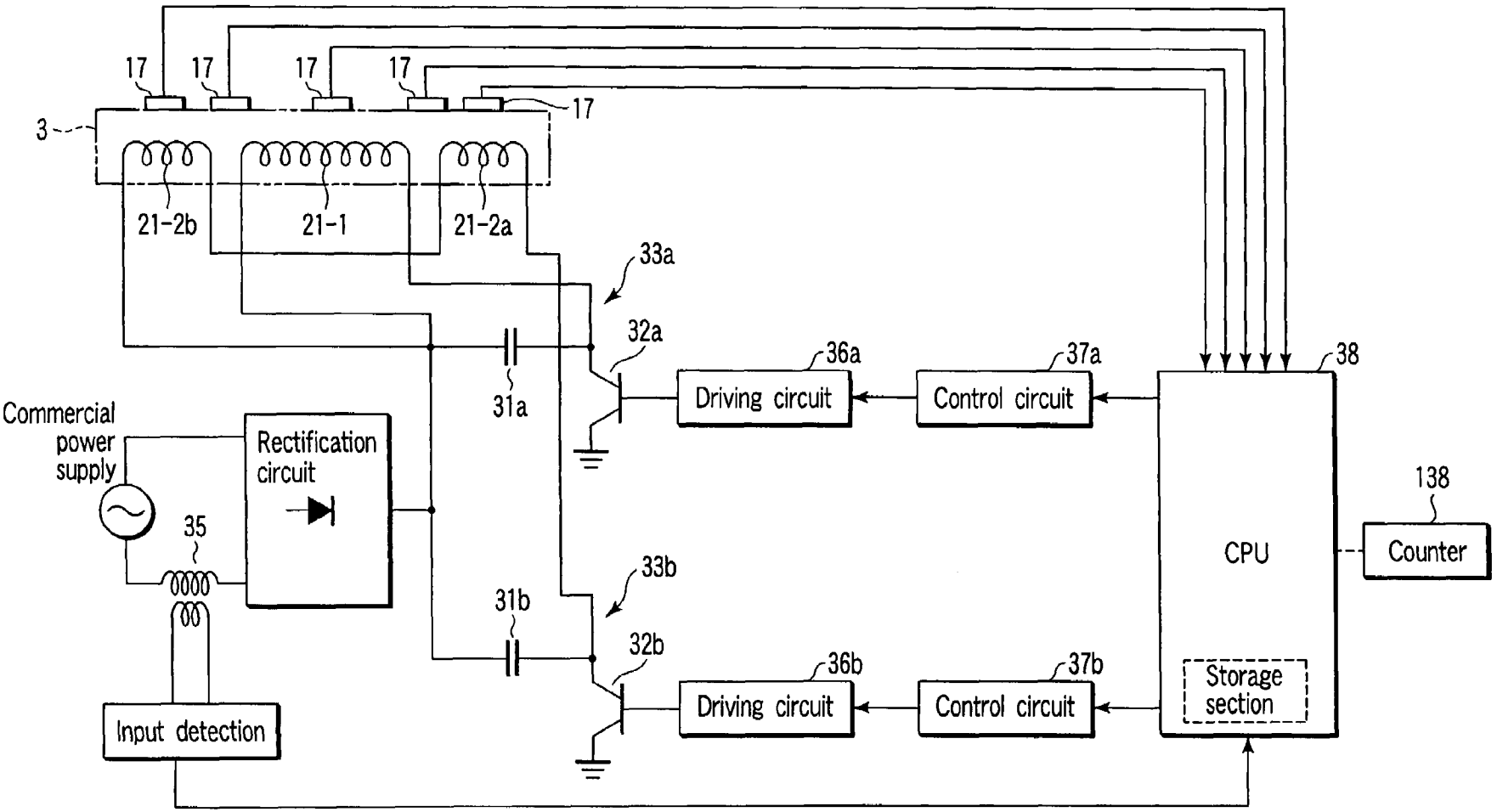
FIG. 4 is a schematic diagram showing one example of a driving circuit (temperature control circuit) which operates the fixing apparatus shown in FIGS. 1 and 2 (or 3)

FIG. 4 shows one example of a driving circuit (temperature control circuit) which operates the fixing apparatus shown in FIGS. 1 and 2.

The middle coil 21-1 and the end coil 21-2 (the first end coil 21-2*a* and the second end coil 21-2*b* connected in series are treated as one coil) of the heating device 7 are connected in parallel with capacitors 31*a*, 31*b* for resonance. A set of the first coil 21-1 and the capacitor 31*a*, and a set of the second coil 21-2 and the capacitor 31*b* are connected to switching elements 32*a*, 32*b*. In the individual switching elements 32*a*, 32*b*, for example, an insulated gate bipolar transistor (IGBT) capable of supplying a current, for example, of about 100 amperes (A), an electric field transistor (MOS-FET) and the like are usable.

A first inverter circuit 33*a* is defined by the middle (first) coil 21-1, capacitor 31*a*, and switching element 32*a*, and a second inverter circuit 33*b* is defined by the end (second) coil 21-2, capacitor 31*b*, and switching element 32*b*.

A direct current which is rectified by a rectification circuit 34 and whose ripple content is smoothed into a predetermined magnitude is supplied to the individual inverter circuits 33*a*, 33*b*. The rectification circuit 34 is connected to a commercial alternating-current power supply. A transformer 35 capable of detecting all power consumption by the heating device 7 (first coil 21-1, second coil 21-2) is disposed in a stage previous to the rectification circuit 34.

Control terminals of the switching elements 32*a*, 32*b* are connected to driving circuits 36*a*, 36*b* which turn on the individual switching elements at predetermined timings. Each of the driving circuits 36*a*, 36*b* applies a predetermined driving voltage to the control terminal of the corresponding switching element. An operation timing of the driving circuit 36*a* or 36*b*, that is, a timing at which the driving voltage is applied to the control terminal of the corresponding switching element 32*a* or 32*b* from the driving circuit 36*a* or 36*b* is instructed by a control circuit 37*a* or 37*b*. The control circuits 37*a*, 37*b* instruct a frequency in a range, for example, of 20 to 60 kHz to the driving circuits 36*a*, 36*b*. When the driving voltages having predetermined frequencies are supplied from the driving circuits 36*a*, 36*b*, the inverter circuits 33*a*, 33*b* defined including the switching elements 32*a*, 32*b* are repeatedly turned on in accordance with the supplied frequencies. When the inverter circuits 33*a*, 33*b* are repeatedly turned on in accordance with the supplied frequencies, currents having predetermined magnitudes are supplied to the first coil 21-1 and second coil 21-2 in the inverter circuits 33*a*, 33*b*. The magnitude of the current is defined in accordance with the magnitude of the heat to be generated by the heat roller 3. In other words, the magnitude of the heat generated by the heat roller 3 depends on the frequency instructed from the control circuits 37*a*, 37*b*.

The heat generated from the heat roller 3 is detected for each position of the temperature detection mechanism 17 in the longitudinal direction of the heat roller 3 by the non-contact temperature detection means, that is, the temperature detection mechanism 17. Temperature information of an arbitrary position of the heat roller 3 in the longitudinal direction detected by the temperature detection mechanism 17 is input into a temperature control CPU 38. When a structure of the temperature detection mechanism 17 separately requires an ASIC section, a temperature detection circuit is disposed between the mechanism and the temperature control CPU 38. When a contact type temperature sensor (not shown) is disposed besides or inside the temperature detection mechanism 17, its output signal (temperature data) is also input into the temperature control CPU 38.

The temperature control CPU 38 specifies an inverter circuit to be turned on and the frequency to be supplied referring to temperature information input from each temperature detection mechanism 17 and quantity of heat required in the heat roller 3 and/or the temperature distribution in the longitudinal direction of the heat roller 3.

The specified frequencies are input into the driving circuits 36*a*, 36*b* via the control circuits 37*a*, 37*b*. The driving voltage having the frequency specified by the temperature control CPU 38 is supplied to the control terminal of the corresponding switching element 32*a*, 32*b* from the driving circuit 36*a*, 36*b*. Therefore, the quantity of heat required for the heat roller 3 and/or the temperature distribution in the longitudinal direction of the heat roller 3 are optimized based on the size of the sheet to be fixed.

In the fixing apparatus shown in FIGS. 1 and 2 and the driving circuit shown in FIG. 4, an example in which two (sets of) coils are disposed has been described, but the number of (the sets of) the coils may be arbitrarily set, and three (sets) or more may be disposed. The temperature detection mechanisms 17 are preferably increased in accordance with the number of the coils. As to at least the number of the coils required, the number of the sets of the coils is added to the number of the coils.

Figure 5:
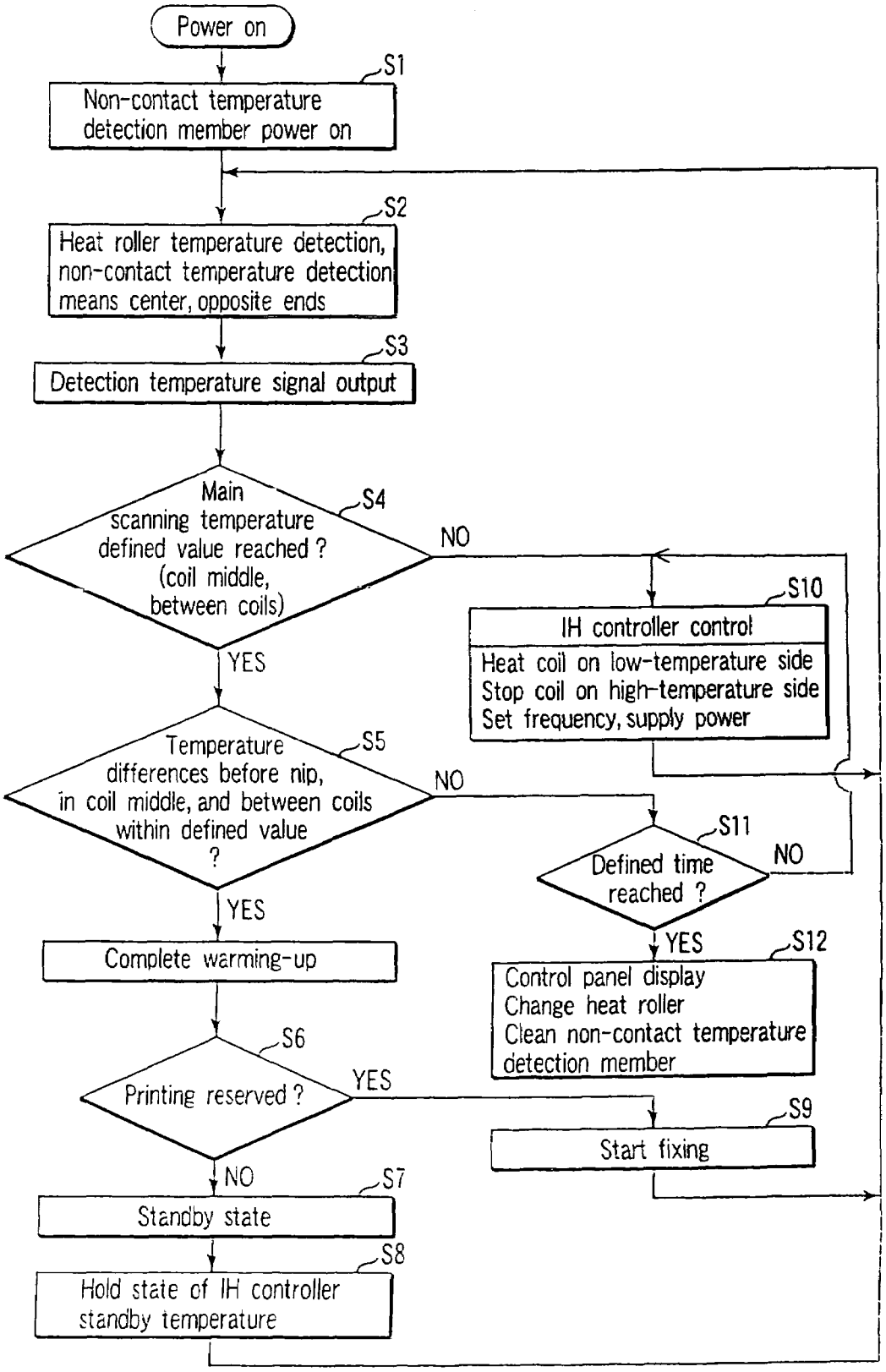
FIG. 5 is a schematic diagram showing one example in which temperature of a heat roller of the fixing apparatus shown in FIGS. 1 and 2 is set by the driving circuit shown in FIG. 4.

FIG. 5 shows an example in which the temperature of the heat roller of the fixing apparatus shown in FIGS. 1 and 2 is set by the driving circuit shown in FIG. 4.

When an image forming apparatus (not shown) is started, all temperature sensors 17 are turned on. Moreover, the power having a predetermined frequency is supplied to all the first and second coils (S1).

Self temperature data and roller temperature detection signal (infrared-ray detection value) are output from ambient temperature detection sections (not shown) of the individual temperature sensors 17 and thermopile sections (not shown). It is to be noted that when a contact type thermistor is disposed (in each temperature sensor 17), an output of the contact type thermistor is usable in the detection of self temperature (S2).

A detected temperature signal indicating the temperature of the surface of the heat roller 3 corresponding to the position of each temperature sensor 17 is obtained from self temperature data output from each temperature sensor 17 and roller temperature detection signal (infrared-ray detected value) (S3).

It is judged by the temperature control CPU 38 whether or not the temperature of the surface has reached reference temperature concerning all regions in the longitudinal direction (axial direction, i.e., main scanning direction) of the heat roller 3 based on the detected temperature signal. It is also judged whether or not the temperature has reached the reference temperature concerning the peripheral direction of the heat roller 3. An order in which the temperature data (detection signal) is output can be arbitrarily set. It is also possible to set a latching timing on the side of the temperature control CPU 38 (S4).

When it is detected that the temperature of the surface of the heat roller 3 has reached the reference temperature in step S4 (S4-Yes), it is judged by the temperature control CPU 38 whether or not a difference between the temperature in the region where the temperature is raised by the first coil 21-1 and that in the region where the temperature is raised by the second coil 21-2 is in a predetermined range so that the temperature immediately before the nip N between the heat roller 3 and the press roller 5 reaches a target temperature in all the regions of a main scanning direction. If necessary, temperature unevenness (ripple) in the peripheral direction of the heat roller 3 is also judged (S5).

When the temperature difference on the surface of the heat roller 3 is within the predetermined range in the step S5 (S5-Yes), it is checked whether or not printing (output) is reserved (S6).

When the printing (output) is not reserved in the step S6 (S6-No), "standby routine" is executed (S7), and "standby control routine" for holding the temperature of the surface of the heat roller 3 at "standby temperature" is executed (S8).

When the printing (output) is reserved in the step S6 (S6-Yes), the sheet S to which a toner image has been transferred is supplied to the nip N between the heat roller 3 and the press roller 5 subsequently to "printing operation (image forming step)", and "fixing step" of fixing the toner to the sheet S starts (S9).

When it is detected in the step S4 that the temperature of the surface of the heat roller 3 does not rise at the reference temperature (S4-No), "temperature raising routine (warming-up)" is executed. That is, the power having the predetermined frequency is continuously supplied to all the coils (S10).

When the temperature difference of the surface of the heat roller 3 is larger than a predetermined magnitude in the step S5 (there is a ripple, i.e., temperature unevenness) (S5-No), it is checked whether or not a time until the temperature of the region where the temperature is raised by one of the coils reaches the reference temperature is within a defined time (S11).

It is detected in the step S11 that the time until the temperature of the region where the temperature is raised by one of the coils reaches the reference temperature is within the defined time although there is temperature unevenness in the temperature of the surface of the heat roller 3 (S11-No). In this case, the "temperature raising routine (warming-up)" of the step S10 is executed. In this case, the power having the predetermined frequency is supplied to the coil capable of heating the region where the temperature of the surface of the heat roller 3 is low.

Figure 6:
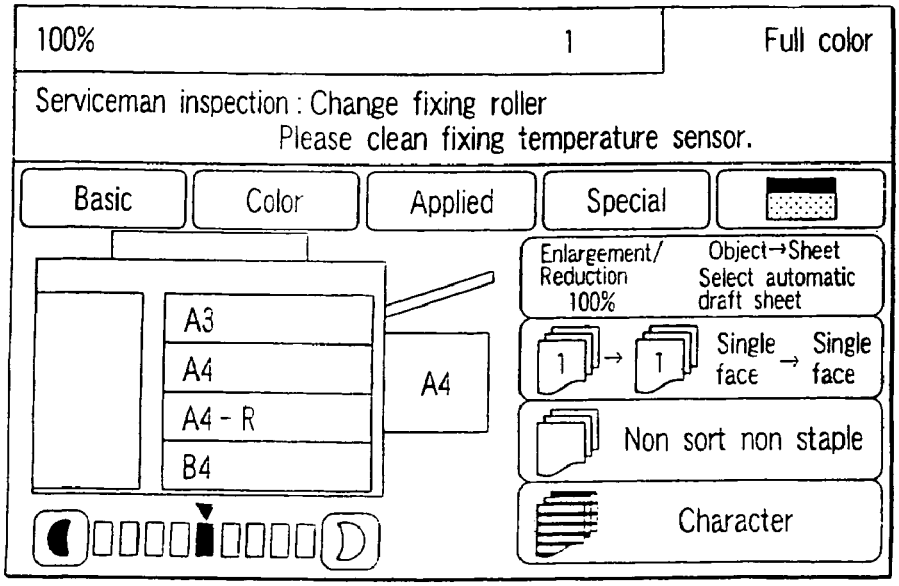
FIG. 6 is a schematic diagram showing one example of display shown in a display section in a step of setting the temperature, shown in FIG. 7.

In the step S11, the time until the temperature of the region where the temperature is raised by one of the coils on the surface of the heat roller 3 reaches the reference temperature exceeds the defined time (the temperature does not rise within the defined time) (S11-Yes). In this case, it is judged "the surface of the heat roller 3 is deteriorated". In this case, in a display section of the image forming apparatus, for example, as shown in FIG. 6, a message urging maintenance such as "heat roller change/temperature sensor cleaning" is displayed (S12).

It is to be noted that when "standby routine" is set in the step S7, the temperature of the surface of the heat roller 3 is maintained at a first standby temperature which can be restored at a temperature at which printing-out is possible in a predetermined time for a constant time even in a case where reservation for the printing (output) is input in the step S6. When the temperature of the surface of the heat roller 3 is maintained at the first standby temperature, in the same manner as in the step S5, the powers having the predetermined frequencies are continuously supplied independently or simultaneously to the first and second coils in such a manner that temperature unevenness (ripple) is within a predetermined range in the longitudinal direction of the heat roller 3. It is to be noted that the powers may be non-continuously supplied to the individual coils based on the output of the temperature sensor 17 (the supplying of the powers to all the coils is sometimes stopped with a change of the frequency of the supplied power in order to prevent the temperature of the surface of the heat roller 3 from being raised at first standby temperature).

When the reservation for the printing (output) is input in the step S6, and "fixing step" is executed in the step S9, the coil to which the power is supplied, the time for which the power is supplied, or the frequency of the power is sometimes changed in accordance with the size of the sheet S. For example, when the length (width) of the image forming region is shorter than that of the heat roller 3, the time for which the power is supplied to the second (end) coil 21-2 is set to be short as compared with the time for which the power is supplied to the first (middle) coil 21-1. The time for which the power is supplied to the individual coils is set to be constant, and the frequency to be supplied may be changed for each coil (a case where level of interference sound generated depending on the difference of the frequency is in a predetermined range).

On the other hand, when larger heat is absorbed at a fixing time as compared with a usual sheet S, the powers supplied to the arbitrary/all coils are increased based on the outputs of the individual temperature sensors 17 (the frequency is changed). For example, when the toners corresponding to a plurality of colors decomposed based on subtractive primaries are in a stacked state, or when an output medium (sheet S) is thick, a target defined temperature of the heat roller 3 differs especially with respect to the size of the output medium, medium type, and output medium thickness. For example, when the output medium is thick, the target defined temperature is raised. The power supplied to the arbitrary coil is controlled in such a manner that the temperature of the heat roller 3 is a target temperature with respect to temperature drop or temperature ripple.

Figure 8:
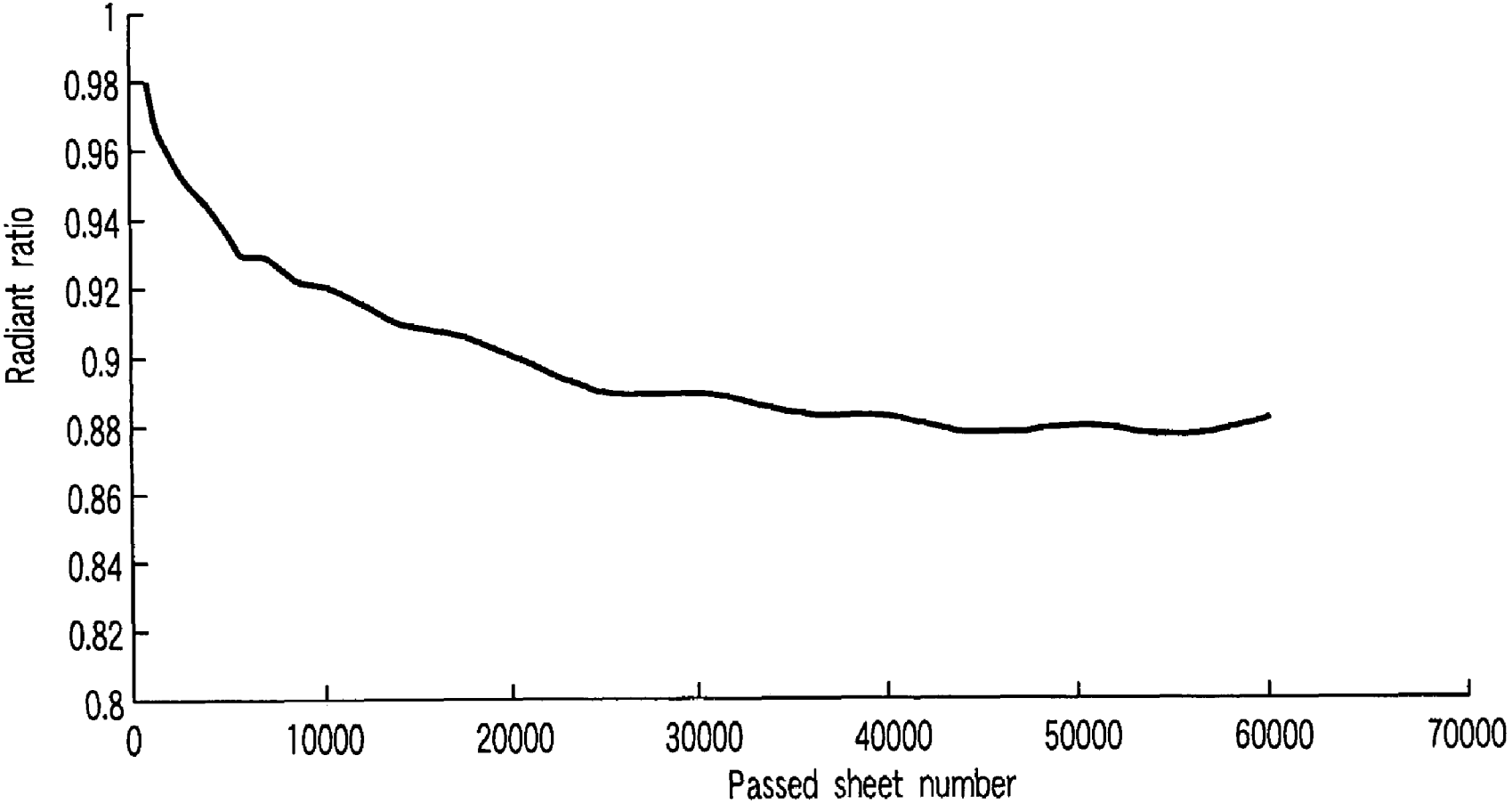
FIG. 8 is a schematic diagram showing a relation between the totaled number of passed sheets and the radiant ratio of the surface of the heat roller in the fixing apparatus shown in FIGS. 1 and 2.

Additionally, it has been known that the surface of the heat roller 3 wears and/or deteriorates depending on the totaled size of the supplied output medium, and the type or thickness of the output medium, and radiant ratio fluctuates in the arbitrary position in the main scanning direction. For example, as shown in FIG. 8, when the number of passed sheets reaches about twenty thousand sheets, the radiant ratio drops by about 10% as compared with an initial state. It is to be noted that this deterioration ratio also depends on the type of the passed sheet (output medium) S. Therefore, as described later, infrared-ray quantity from the heat roller 3 and intensity (emission ratio) of rays (for detection) radiated from the temperature sensor 17 are changed.

When the radiant ratio changes in this manner, and even when the actual temperature of the heat roller 3 is equal in the main scanning direction, a detection result (temperature data) output from the temperature sensor 17 is the temperature that differs with each position in the main scanning direction of the heat roller 3. It is to be noted that the radiant ratio can be arbitrarily set in accordance with one or a plurality of sets of fixing size, image output times (fixed sheet number), roller rotation number and the like. Needless to say, the deterioration ratio (radiant ratio) may be set, for example, based on a counter value held by a counter 138 connected to the CPU 38 (or a storage section defined as firmware of the CPU 38), that is, the image forming times.

Therefore, the cleaning roller 13 contains an abrasive for polishing the surface of the heat roller 3 beforehand, and the radiant ratio of the heat roller 3 is preferably uniformed. A heat-resistant temperature of the abrasive is preferably 200° C. or more, and, for example, colloidal silica, diamond (slurry), alumina (aluminum oxide), cerium oxide, zirconia (zirconium oxide), ceramics, nickel and the like are usable.

It is to be noted that the abrasive may be mixed in the oil supplied to the heat roller 3 by the oil roller 15. The color or resistance to water/oil is not especially restricted.

For example, particle diameters of the abrasives are as follows:

| | |
|---|---|
| colloidal silica | 0.02 to 0.05 (μm); |
| diamond (slurry) | 0.2 to 8 (μm); |
| aluminum oxide (alumina) | 0.05 to 5 (μm); and |
| cerium oxide | 0.01 to 4 (μm). |

It is to be noted that in a case where a predetermined time elapses from when the surface of the heat roller 3 is maintained at the first standby temperature, or a predetermined time elapses after the "fixing step" of the step S9 ends, the surface of the heat roller 3 is maintained at a second standby temperature at which power consumption is smaller than that at the first standby temperature. The second standby temperature is a temperature at which the temperature of the heat roller 3 can be reset at a temperature at which the "fixing step" is executable within a defined time in a case where the powers are supplied to the individual coils at a time when the printing (output) is instructed. Needless to say, the powers to be supplied to the individual coils are controlled based on the temperature or the temperature signal of the heat roller 3 output from the temperature sensor 17.

Figure 7:
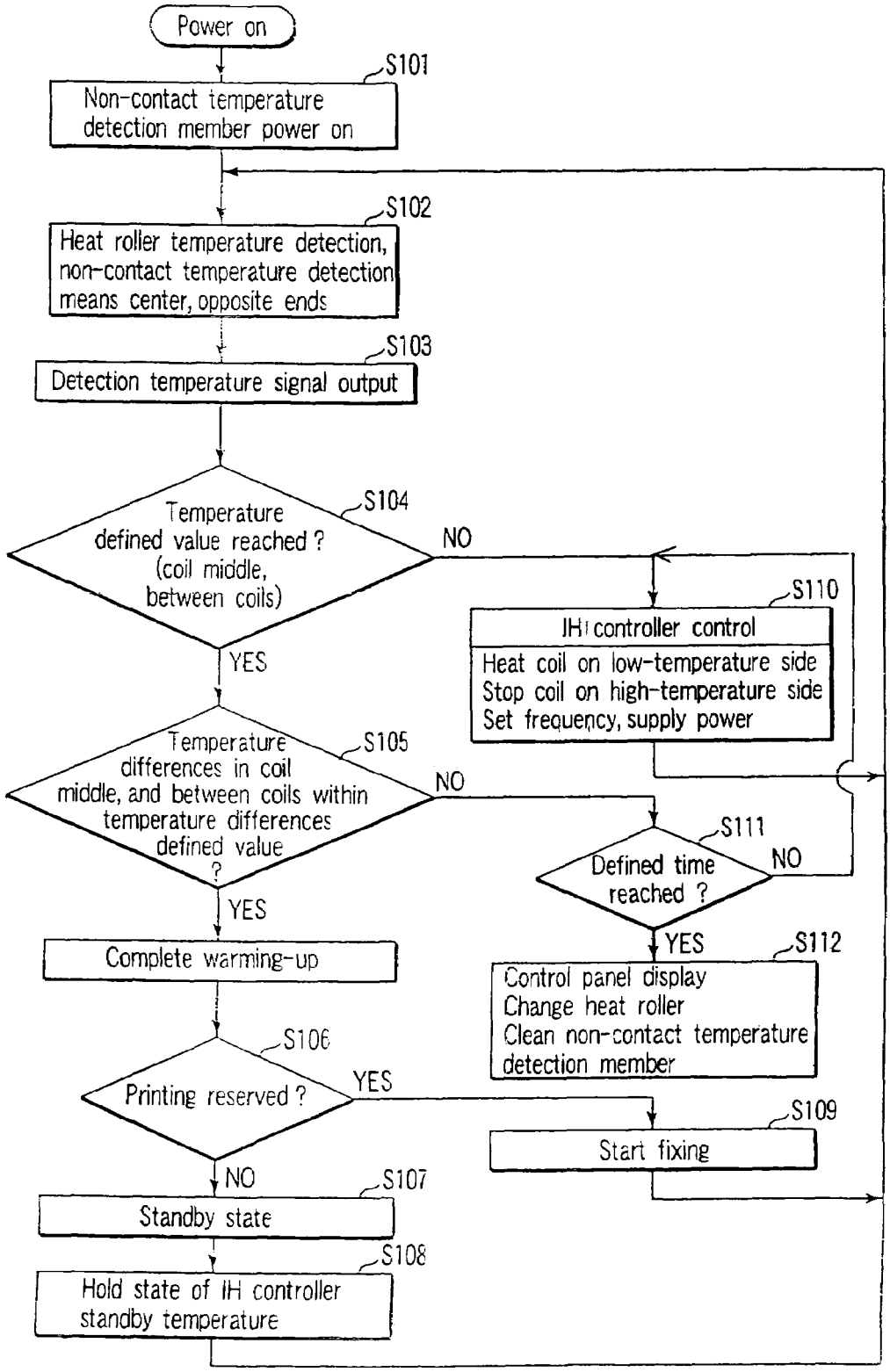
FIG. 7 is a schematic diagram showing another example in which the temperature of the heat roller of the fixing apparatus shown in FIGS. 1 and 2 is set by the driving circuit shown in FIG. 4.

FIG. 7 shows another example in which the temperature of the heat roller of the fixing apparatus shown in FIGS. 1 and 2 is set by the driving circuit shown in FIG. 4.

When an image forming apparatus (not shown) is started, all temperature sensors 17 are turned on. Moreover, the power having a predetermined frequency is supplied to all the first and second coils (S101).

Self temperature data and roller temperature detection signal (infrared-ray detection value) are output from ambient temperature detection sections (not shown) of the individual temperature sensors 17 and thermopile sections (not shown). It is to be noted that when a contact type thermistor is disposed (in each temperature sensor 17), an output of the contact type thermistor is usable in the detection of the self temperature (S102).

A detected temperature signal indicating the temperature of the surface of the heat roller 3 corresponding to the position of each temperature sensor 17 is obtained from self temperature data output from each temperature sensor 17 and roller temperature detection signal (infrared-ray detected value) (S103).

It is judged by the temperature control CPU 38 whether or not the surface has reached the reference temperature concerning all regions in the longitudinal direction (axial direction, i.e., main scanning direction) of the heat roller 3 based on the detected temperature signal. It is also judged whether or not the temperature has reached the reference temperature concerning the peripheral direction of the heat roller 3. An order in which the temperature data (detection signal) is output can be arbitrarily set. It is also possible to set a latching timing on the side of the temperature control CPU 38 (S104).

When it is detected that the temperature of the surface of the heat roller 3 has reached the reference temperature in step S104 (S104-Yes), it is judged by the temperature control CPU 38 whether or not a difference between the temperature in the region where the temperature is raised by the first coil 21-1 and that in the region where the temperature is raised by the second coil 21-2 is in a predetermined range. If necessary, temperature unevenness, that is, ripple in the peripheral direction of the heat roller 3 is also judged (S105).

When the temperature difference on the surface of the heat roller 3 is within the predetermined range in the step S105 (S105-Yes), it is checked whether or not printing (output) is reserved (S106).

When the printing (output) is not reserved in the step S106 (S106-No), "standby routine" is executed (S107), and "standby control routine" for holding the surface of the heat roller 3 at the "standby temperature" is executed (S108).

When the printing (output) is reserved in the step S106 (S106-Yes), the sheet S to which a toner image has been transferred is supplied to the nip N between the heat roller 3 and the press roller 5 subsequently to the "printing operation (image forming step)", and the "fixing step" of fixing the toner to the sheet S starts (S109).

When it is detected in the step S104 that the temperature of the surface of the heat roller 3 does not rise at the reference temperature (S104-No), the "temperature raising routine (warming-up)" is executed. That is, the power having the predetermined frequency is continuously supplied to all the coils (S110).

When the temperature difference of the surface of the heat roller 3 is larger than a predetermined magnitude in the step S105, that is, there is a ripple (temperature unevenness) (S105-No), it is checked whether or not a time until the temperature of the region where the temperature is raised by one of the coils reaches the reference temperature is within a defined time (S111).

It is detected in the step S111 that the time until the temperature of the region where the temperature is raised by one of the coils reaches the reference temperature is within the defined time although there is the temperature unevenness in the temperature of the surface of the heat roller 3 (S111-No). In this case, the "temperature raising routine (warming-up)" of the step S110 is executed. In this case, the power having the predetermined frequency is supplied to the coil capable of heating the region where the temperature of the surface of the heat roller 3 is low. At this time, the temperature data (roller temperature, infrared-ray detection value) output from the individual temperature sensors 17 differs with each sensor. The infrared-ray emission ratio from the heat roller 3 also fluctuates in accordance with the position of the heat roller 3 in the main scanning direction. Therefore, the intensity (emission ratio) of the ray (for detection) radiated toward the heat roller 3 from the thermopile section (not shown) of the temperature sensor 17 is changed based on the relation between the passed sheet number and the drop of the radiant ratio shown in FIG. 8.

The infrared-ray emission ratio of each temperature sensor 17 is set beforehand in such a manner as to increase in accordance with the deterioration or the surface of the heat roller 3 as compared with an initial stage. In this case, needless to say, a change (change ratio) of the radiant ratio is set beforehand in such a manner that an error of the detected temperature falls within a predetermined range. The emission quantity of infrared rays is determined based on deterioration ratio held, for example, in a counter 138 (or a storage section defined as firmware of the CPU 38) connected to the CPU 38.

In the step S111, the time until the temperature of the region where the temperature is raised by one of the coils on the surface of the heat roller 3 reaches the reference temperature exceeds the defined time (the temperature does not rise within the defined time) (S111-Yes). In this case, it is judged that "the surface of the heat roller 3 is deteriorated".

In this case, in a display section of the image forming apparatus, for example, as shown in FIG. 6, a message urging maintenance such as "heat roller change/temperature sensor cleaning" is displayed (S112).

It is to be noted that when "standby routine" is set in the step S107, the temperature of the surface of the heat roller 3 is maintained at a first standby temperature which can be restored at a temperature at which printing-out is possible in a predetermined time for a constant time even in a case where reservation for the printing (output) is input in the step S106. When the temperature of the surface of the heat roller 3 is maintained at the first standby temperature, in the same manner as in the step S105, the powers having the predetermined frequencies are continuously supplied independently or simultaneously to the first and second coils in such a manner that temperature unevenness (ripple) is within a predetermined range in the longitudinal direction of the heat roller 3. It is to be noted that the powers may be non-continuously supplied to the individual coils based on the output of the temperature sensor 17 (the supplying of the powers to all the coils is sometimes stopped with a change of the frequency of the supplied power in order to prevent the temperature of the surface of the heat roller 3 from being raised at first standby temperature).

When the reservation for the printing (output) is input in the step S106, and the "fixing step" is executed in the step S109, the coil to which the power is supplied, the time for which the power is supplied, or the frequency of the power is sometimes changed in accordance with the size of the sheet S. For example, when the length (width) of the image forming region is shorter than that of the heat roller 3, the time for which the power is supplied to the second (end) coil 21-2 is set to be short as compared with the time for which the power is supplied to the first (middle) coil 21-1. The time for which the power is supplied to the individual coils is set to be constant, and the frequency to be supplied may be changed for each coil (a case where level of interference sound generated depending on the difference of the frequency is in a predetermined range).

On the other hand, when larger heat is absorbed at a fixing time as compared with a usual sheet S, the powers supplied to the arbitrary/all coils are increased based on the outputs of the individual temperature sensors 17 (the frequency is changed). For example, when the toners corresponding to a plurality of colors decomposed based on subtractive primaries are in a stacked state, or when an output medium (sheet S) is thick, a target defined temperature of the heat roller 3 differs especially with respect to the size of the output medium, medium type, and output medium thickness.

Additionally, it has been known that the surface of the heat roller 3 wears and/or deteriorates depending on the totaled size of the supplied output medium, and the type or thickness of the output medium, and radiant ratio fluctuates in the arbitrary position in the main scanning direction. For example, as shown in FIG. 8, when the number of passed sheets reaches about twenty thousand sheets, the radiant ratio drops by about 10% as compared with an initial state. It is to be noted that this deterioration ratio also depends on the type of the passed sheet (output medium) S. Therefore, as described later, infrared-ray quantity from the heat roller 3 and intensity (emission ratio) of rays (for detection) radiated from the temperature sensor 17 are changed. The deterioration ratio increases, when a required thermal capacity accompanying the fixing operation is larger. Therefore, a converted value of the radiant ratio of the infrared rays from the heat roller 3 is changed based on the deterioration ratio.

Thus, the converted value is corrected in a detection position of the infrared ray from the heat roller 3 by each temperature sensor 17. Accordingly, the temperature difference of the heat roller 3 in the longitudinal direction (main scanning direction) is maintained to be substantially constant in the life regardless of the type, thickness, and size (main scanning direction length) of the output medium (sheet) S and the total number of passed (image formed) sheets.

As described above, according to a method of setting the temperature of the heat roller of the fixing apparatus using the thermopile type temperature sensor of the present invention, a) friction or the like by contact with the temperature detection device is prevented from being caused in the fixed image;

b) the ripple (temperature unevenness) of the temperature of the heat roller surface is reduced;

c) the range of the controlled temperature is enhanced (temperature difference is reduced) in the temperature control for the heat roller using the induction heating;

d) traces of temperature changes (ripples) are inhibited from being left (generated) in the fixed image; and e) a warming-up time can be reduced.

Therefore, the power consumption is also reduced. A quality of the toner image formed on the output material can be enhanced. It is to be noted that in the embodiment of the present invention, an induction heating system has been described as an example of the heating mechanism for raising the temperature of the heat roller, but the heating mechanism is not especially restricted as long as the temperature of the heat roller in the longitudinal direction can be independently controlled.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A temperature control method comprising:

detecting infrared from a heat generating roller to obtain a temperature signal;

specifying a conversion coefficient for use in converting the temperature signal into temperature data on a surface of the heat generating roller by using at least one of detection position, a surface state of the heat generating roller, and the number of times accumulated image formation is performed;

correcting the detected temperature data on the surface of the heat generating roller based on the specified conversion coefficient; and controlling a power to be supplied to coil members which raise a temperature of the heat generating roller based on the corrected temperature data, wherein the conversion coefficient for use in converting the temperature signal into temperature data is specified by using each of: a) the detection position, b) the surface state of the heat generating roller, and c) the number of times accumulated image formation is performed.

2. A fixing apparatus comprising:

a heat generating roller which generates heat;

infrared-ray detecting sensors which detect infrared rays radiated from the heat generating roller, and outputs a value of a radiation of the infrared rays;

a temperature determining unit which converts the value of the radiation of the infrared rays into temperature data at a predetermined conversion rate;

at least two coil members which provide a magnetic field for use in generating the heat with the heat generating roller, wherein the coil members are arranged along a longitudinal direction of the heat generating roller, with a gap provided between the coil members; and a counting unit which counts at least one of a total time period of rotation of the heat generating roller and the total number of times image formation is performed, and outputs the at least one of a value of the total time period of rotation of the heat generating roller and the total number of times image formation is performed, wherein the conversion rate is changed in accordance with the value of the at least one of the total time period of rotation of the heat generating roller and the total number of times image formation is performed, which is output from the counting unit, and wherein one of the infrared-ray detecting sensors is located opposite to the gap between the coil members and parallel to the heat generating roller, and another one of the infrared-ray detecting sensors is located opposite to one of the coil members and parallel to the heat generating roller.

3. The fixing apparatus according to claim 2, further comprising a surface state maintaining mechanism which causes a quantity of the infrared rays radiated from the heat generating roller to fall within a predetermined range.

4. The fixing apparatus according to claim 3, wherein the surface state maintaining mechanism causes the quantity of the infrared rays to fall within the predetermined range with respect to the surface state of the heat generating roller regardless of the number of times image formation is performed, size and thickness of the recording material, and/or material of the recording material.

5. The fixing apparatus according to claim 3, wherein the surface state maintaining mechanism applies an abrasive for polishing the surface of the heat generating roller to the surface thereof.

6. The fixing apparatus according to claim 2, wherein the infrared-ray detecting sensors are located opposite to heating regions of the heat generating roller, and arranged parallel to the heat generating roller.

7. An image forming apparatus comprising a fixing unit which includes:

a heat generating roller which generates heat;

infrared-ray detecting sensors which detect infrared rays radiated from the heat generating roller, and outputs a temperature signal which includes a value of a radiation of the infrared-rays;

a temperature determining unit which converts the value of the radiation of the infrared rays provided in the temperature signal into temperature data at a predetermined conversion rate; and a counting unit which counts at least one of a total time period of rotation of the heat generating roller and the total number of times image formation is performed, and outputs a value of the at least one of the total time period of rotation of the heat generating roller and the total number of times image formation is performed, wherein the conversion rate is changed in accordance with the value of the at least one of the total time period of rotation of the heat generating roller and the total number of times image formation is performed, which is output from the counting unit, and wherein a conversion coefficient for use in converting the temperature signal into temperature data is specified by using each of: a) detection position, b) a surface state of the heat generating roller, and c) the number of times accumulated image formation is performed.

* * * * *